US005784839A

United States Patent [19]

LaVanway

[11] Patent Number: 5,784,839

[45] Date of Patent: Jul. 28, 1998

[54] EASY TO ASSEMBLE WINDOW

[75] Inventor: Edward K. LaVanway, Troy, Mich.

[73] Assignee: Weather King Windows and Doors, Inc., Farmington, Mich.

[21] Appl. No.: 803,998

[22] Filed: Feb. 21, 1997

[51] Int. Cl.[6] ..... E05D 15/22

[52] U.S. Cl. ..... 52/204.1; 52/204.64; 52/204.66; 49/463; 49/400

[58] Field of Search ..... 49/463, 161, 176, 49/381, 400; 52/204.1, 204.64, 204.66

[56] References Cited

U.S. PATENT DOCUMENTS

| | | | |
|---|---|---|---|
| 3,091,005 | 5/1963 | Woodhams . | |
| 3,434,236 | 3/1969 | Weidner et al. . | |
| 3,959,926 | 6/1976 | Noecker et al. | 49/463 X |
| 4,922,657 | 5/1990 | Foss . | |
| 4,930,254 | 6/1990 | Valentin | 49/176 X |
| 4,955,159 | 9/1990 | Rogers . | |
| 4,961,286 | 10/1990 | Bezubic . | |
| 4,991,369 | 2/1991 | Lamb | 49/463 X |
| 5,301,734 | 4/1994 | Opel | 49/161 X |
| 5,592,781 | 1/1997 | Mauro . | |

FOREIGN PATENT DOCUMENTS

| | | |
|---|---|---|
| 1534958 | 6/1967 | France . |

*Primary Examiner*—Wynn Wood Coggins
*Attorney, Agent, or Firm*—Howard & Howard

[57] ABSTRACT

An improved window includes pivot pins at each side of the window sash. The pivot pins are received within guide channels in a window frame for mounting the window sash. The window sash may be quickly and easily mounted within the window frame by merely inserting one of the pins, and then moving the other pin into alignment with its channel. The window sash is provided with a two-part stop surface that securely retains the window sash within the window frame. No hardware is required. The window sash is formed with a ledge extending forwardly of the window sash that abuts a forward end of the window frame, and a rear corner of the window sash abuts a rear face of the window frame such that two stop surfaces are provided between the window sash and the window frame.

5 Claims, 4 Drawing Sheets

EASY TO ASSEMBLE WINDOW

BACKGROUND OF THE INVENTION

This invention relates to a pivoting window which is relatively simple to install.

In the prior art, windows are often mounted such that a sash can pivot relative to the window frame between open and closed positions. These windows are particularly widely utilized as basement windows. In the prior art, this type of window has typically required hinges and other hardware to connect the sash to the window frame. The assembly of the window is thus somewhat cumbersome. It would be desirable to simplify mounting the window into the building such that less assembly time is required. In addition, it would be desirable to reduce the costs and complication presented by the attachment of the necessary hinges or other hardware. When a large number of windows are placed into buildings, such as when a residential subdivision is being built, the long assembly time becomes particularly undesirable.

The prior art has proposed the use of pivot pins to mount the sash within the window frame. These pivot pins have typically been held in place by complex mechanisms to secure the pins at a locked position. These mechanisms have restricted movement of the pivot pins and complicated the assembly. Moreover, additional hardware has typically been used to allow the sash to pivot to an open position, and be held at that open position.

It is an object of this invention to reduce the complexity of a window which may pivot between open and closed positions.

SUMMARY OF THE INVENTION

In the disclosed embodiment of this invention, a window sash (glass insert) is mounted within a surrounding window frame on a pair of opposed pivot pins. The pivot pins ride in a channel which closely guides the pivot pins for pivoting movement, and for sliding movement up and down within the channel for a majority of the length of the channel. The pivot pins may be simply attached to the sides of a sash frame which surrounds the window pane or glass.

The window sash is moved between opened and closed positions by pivoting on the pivot pins. A simple latch may be utilized to lock the window sash at its closed position. The window sash may be inserted into the window frame by turning it at a non-parallel angle with the horizontal, inserting one pin into its respective channel, moving the other pin into alignment with its channel, then moving the window sash back down to be parallel to the horizontal plane. With movement back to horizontal, the second pin moves into its channel and the window sash is fully received within the window frame. In this way, it is not necessary to assemble any hardware to connect the window sash to the window frame.

In further features of this invention, the sash frame is provided with structure that presents a stop when the window sash is pivoted to its open position. In a preferred embodiment, the stop includes a surface on a rear portion of the sash frame which abuts a rear surface of the window frame. Further, a forward ledge is formed extending forwardly of the sash frame. The forward ledge abuts a forward end of the window frame to provide a second stop. The two stops securely hold the window sash at the open position, preventing the window from falling in. Preferably, the stop position holds the window sash at a position where it has not reached a parallel orientation with the horizontal. In a most preferred embodiment of this invention, the two stops generally provide line contact between the sash frame and the window frame. The lines are preferably spaced on opposed vertical sides of the center of the pivot pin. In this way, the stop is able to accommodate the weight of the window.

In one embodiment of this invention, the interior of the sash frame is provided with a metal strengthening plate. A screw secures the pivot pin to the frame and extends into the metal plate. The metal plate ensures the screw is securely received within the sash frame.

In a second embodiment, the sash frame is provided with a molded or extruded plastic boss, and the screw extends through the boss.

These and other features of the present invention can be best understood from the following specification and drawings, of which the following is a brief description.

DETAILED DESCRIPTION OF THE PREFERRED EMBODIMENT

Figure 1:
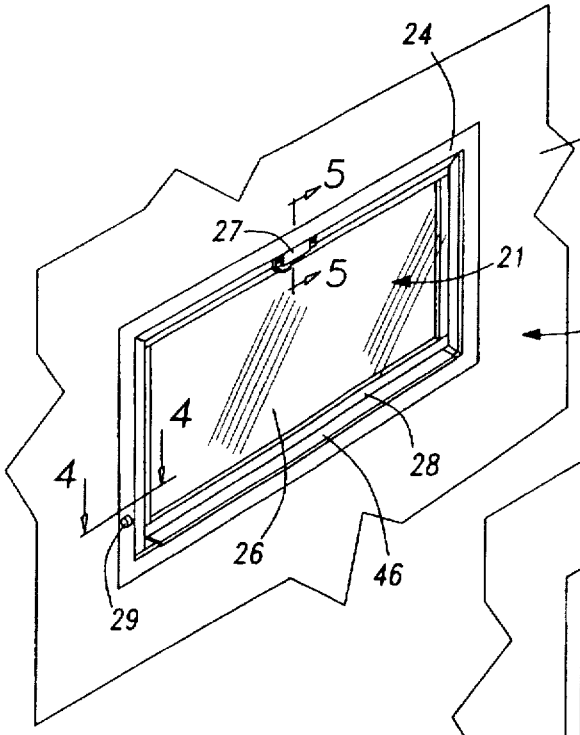
FIG. 1 shows the inventive window in its closed position.

FIG. 1 shows window assembly 20 mounted within a building wall 22. A window frame 24 mounts a window pane 26 and its sash frame 28 (collectively referred to as a sash 21). A latch 27 locks the sash 21 at its closed position. A pivot pin 29 is shown in this figure, but would not be visible in the actual placement of the window 20. Pivot pin 29 allows the window sash 21 to pivot to an open position.

Figure 2:
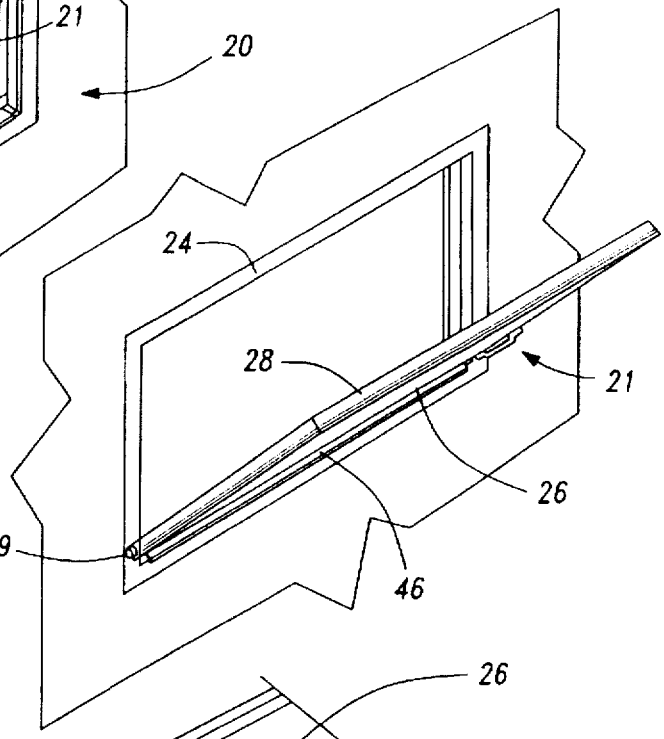
FIG. 2 shows the inventive window pivoted to its open position.

As shown in FIG. 2, window sash 21 is pivoted to an open position. As will be explained below, a stop is provided to hold the window sash 21 in this open position. Thus, the window is opened to a pre-determined angle, and held at that angle. As can be seen the pre-determined angle is less than 90° such that the window sash 21 is not held parallel to the ground. It would be undesirable for the window sash 21 to be able to fall without any restraint.

Figure 3:
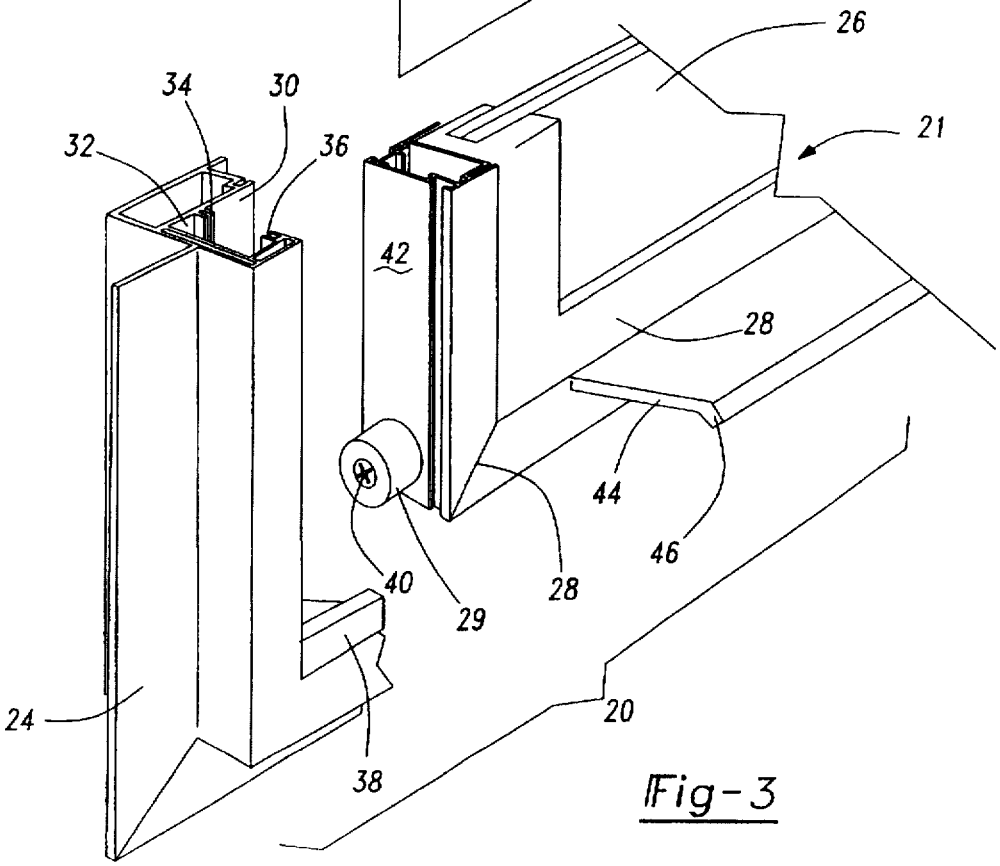
FIG. 3 shows an exploded view of the window sash and window frame.

FIG. 3 shows the window 20, with the window pane 26 and sash frame 28 removed from the window frame 24. As shown, the window frame 24 includes sides having a rear abutment face 30, and a guide channel 32 defined by two laterally inwardly extending ridges 34 and 36. A forward ledge 38 on the window frame 24 will cooperate with a ledge 44 on sash frame 28 to provide a stop as will be discussed below. A screw 40 secures the roller pin 29 to a side strip 42 of the sash frame 28. As shown, ledge 44 extends to an outermost lip 46.

Figure 4:
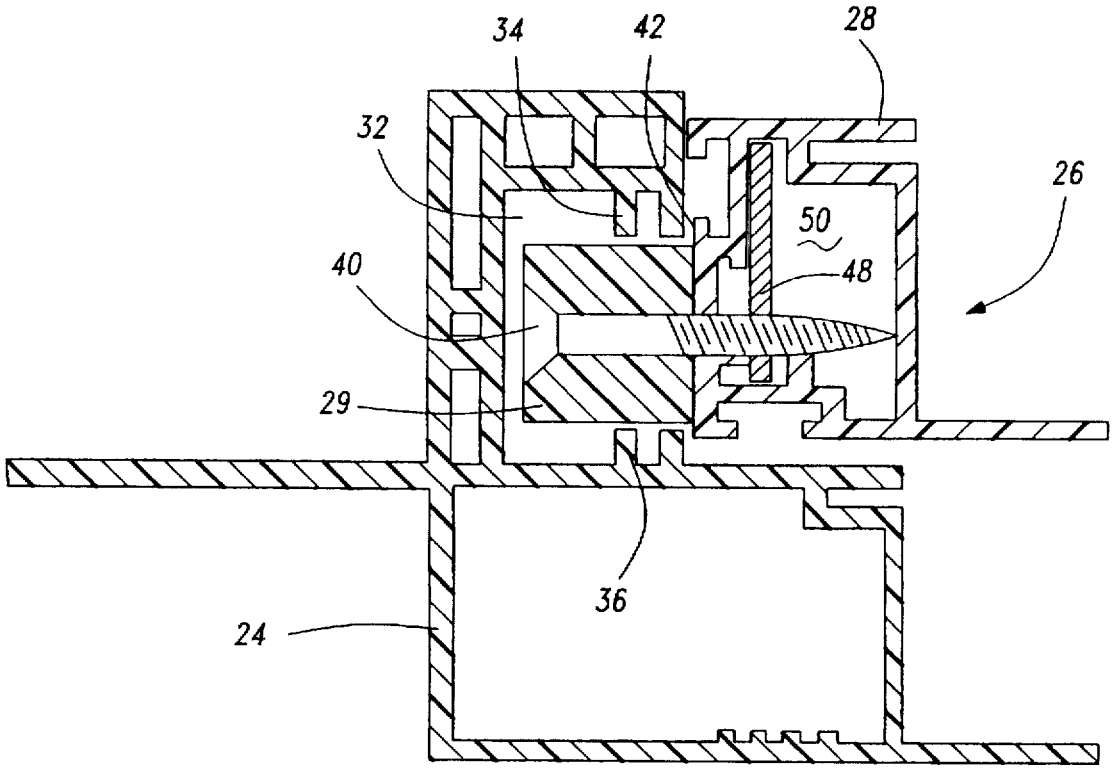
FIG. 4 is a cross-sectional view along line 4—4 as shown in FIG. 1.

As shown in FIG. 4, pivot pin 29 has an outer diameter such that it is closely spaced between the laterally innermost ends of ridges 34 and 36. The screw 40 extends through a metal backing strip 48 placed in a cavity 50 within the sash frame 28.

Channels 32 extend along the majority of the sides of the window frame 24. Thus, sash frame 28 and window pane 26 may move along the sides of the window frame 24 with the pivot pins 29 sliding within channels 32. There is no hardware in the channels that would prevent pivot pins 29 from sliding along a channel. This is important to facilitate assembly, as will be described with reference to FIG. 8.

Figure 5:
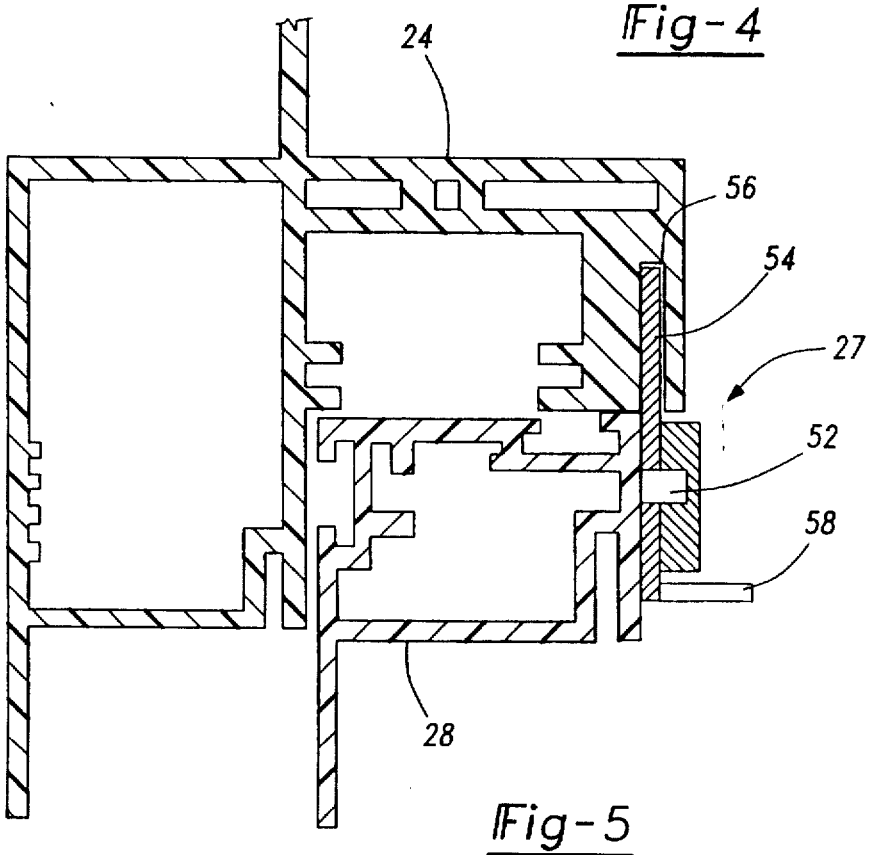
FIG. 5 is a cross-sectional view along line 5—5 as shown in FIG. 1.

As shown in FIG. 5, a latch 27 latches the window sash at the closed position shown in FIG. 1. The latch may include a pivot pin 52 which pivotally attaches a locking clip 54 that extends upwardly into a channel 56 in the window frame 24. A handle 58 allows pivoting movement of the latch 54 to allow the window sash to move to its open position.

Figure 6:
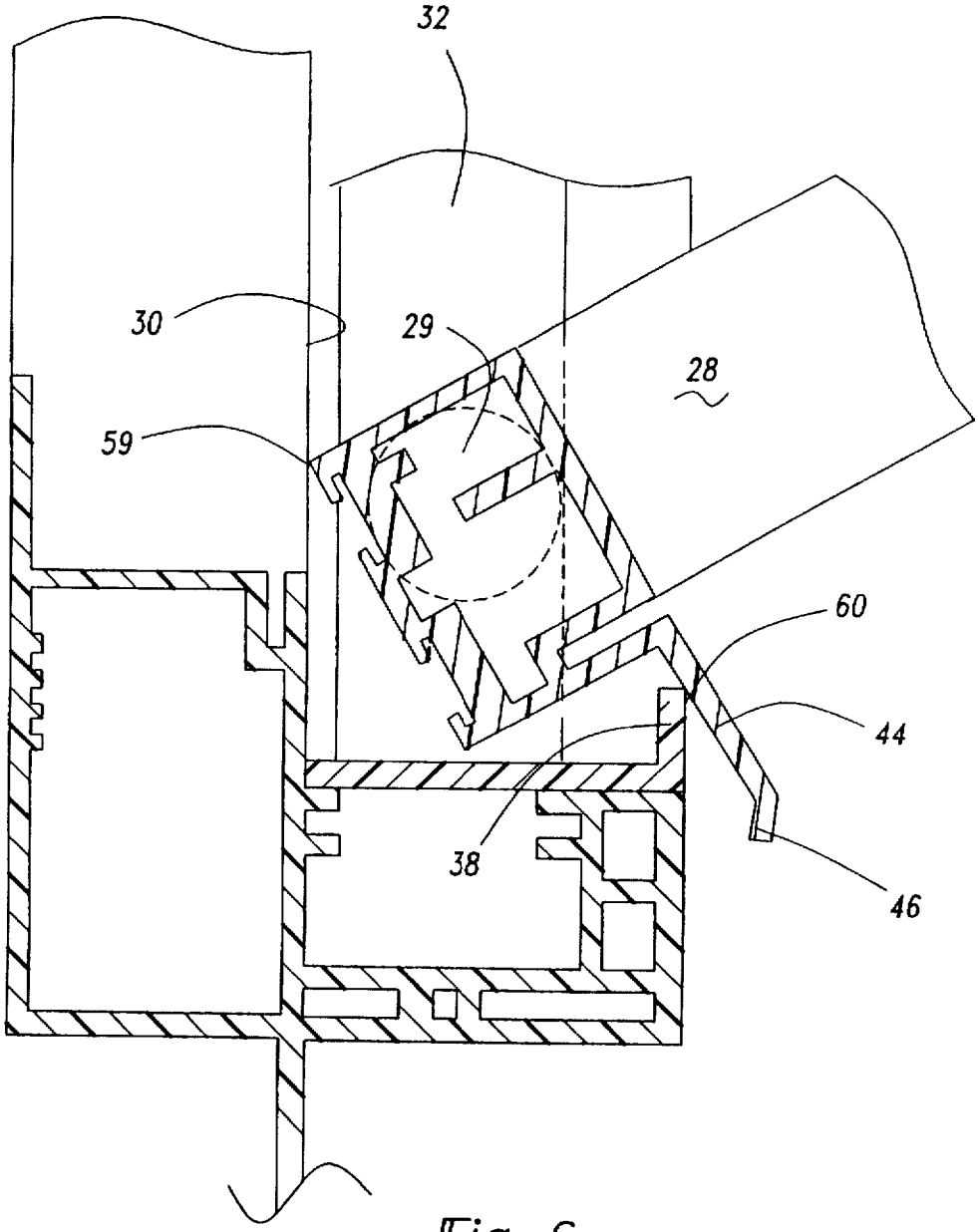
FIG. 6 shows the position of the sash frame relative to the window frame in the open position as shown in FIG. 2.

As shown in FIG. 6, the window sash is at its open position such as shown in FIG. 2. In this position, there are two stop surfaces which hold the window sash securely within the window frame 38. As shown, an abutment face 30 contacts a rearwardmost corner edge 59 of the sash frame 28. This contact occurs along two spaced line segments, at each side of the window frame. Note that the edge 59 is positioned above the central axis of the roller 29 in this position.

At the same time, the ledge 44 abuts the forward ledge 38 at a second contact 60. Contact 60 occurs along the entire ledge of the sash, and is thus line contact. Line 60 is below the central axis of the roller 29. Since the line contacts 59 and 60 are on opposed sides of the central axis of the roller 29, the present invention provides a secure connection holding the window sash 21 at the illustrated open position.

To move the window sash to this open position, the window sash is initially unlatched and pivoted within the window frame. It may be necessary to have the window sash move slightly vertically upwardly as it is pivoting to allow it to pivot to the position such as shown in FIG. 6. This preferably happens automatically. Essentially, corner 59 hits wall 30, and continual pivoting occurs with corner 59 sliding upwardly along face 30 until contact point 60 is made.

In one window embodiment, the pivot pin was mounted about 0.5" up from the bottom of the sash frame. Of course, with different dimensions of frames, this location may vary. In typical applications it can vary by as much as 0.25" in either direction. Note, also, that the pivot pin is spaced toward a rear end of the strip 42, and is not centered on strip 42. As can be seen in FIG. 6, this facilitates the movement to the stopped position.

Figure 7:
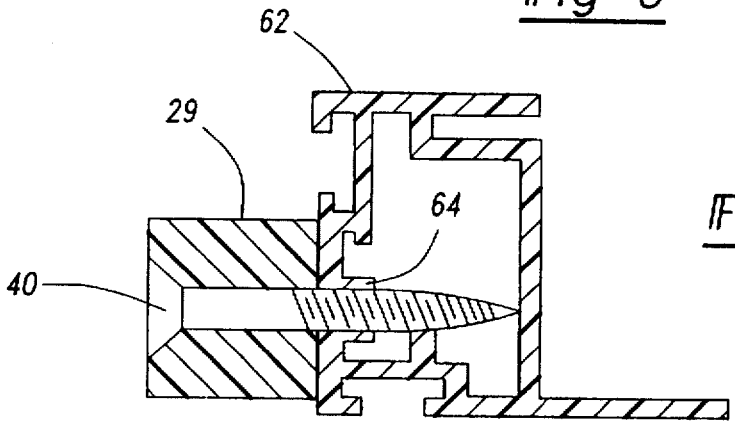
FIG. 7 shows a second embodiment of the present invention.

As shown in FIG. 7, in a second embodiment 62, the sash frame has a boss 64 that receives the screw 40. The boss 64 replaces the metal backing plate of the first embodiment. The purpose of the boss 64 is to provide a surface to receive the screw threads.

Figure 8:
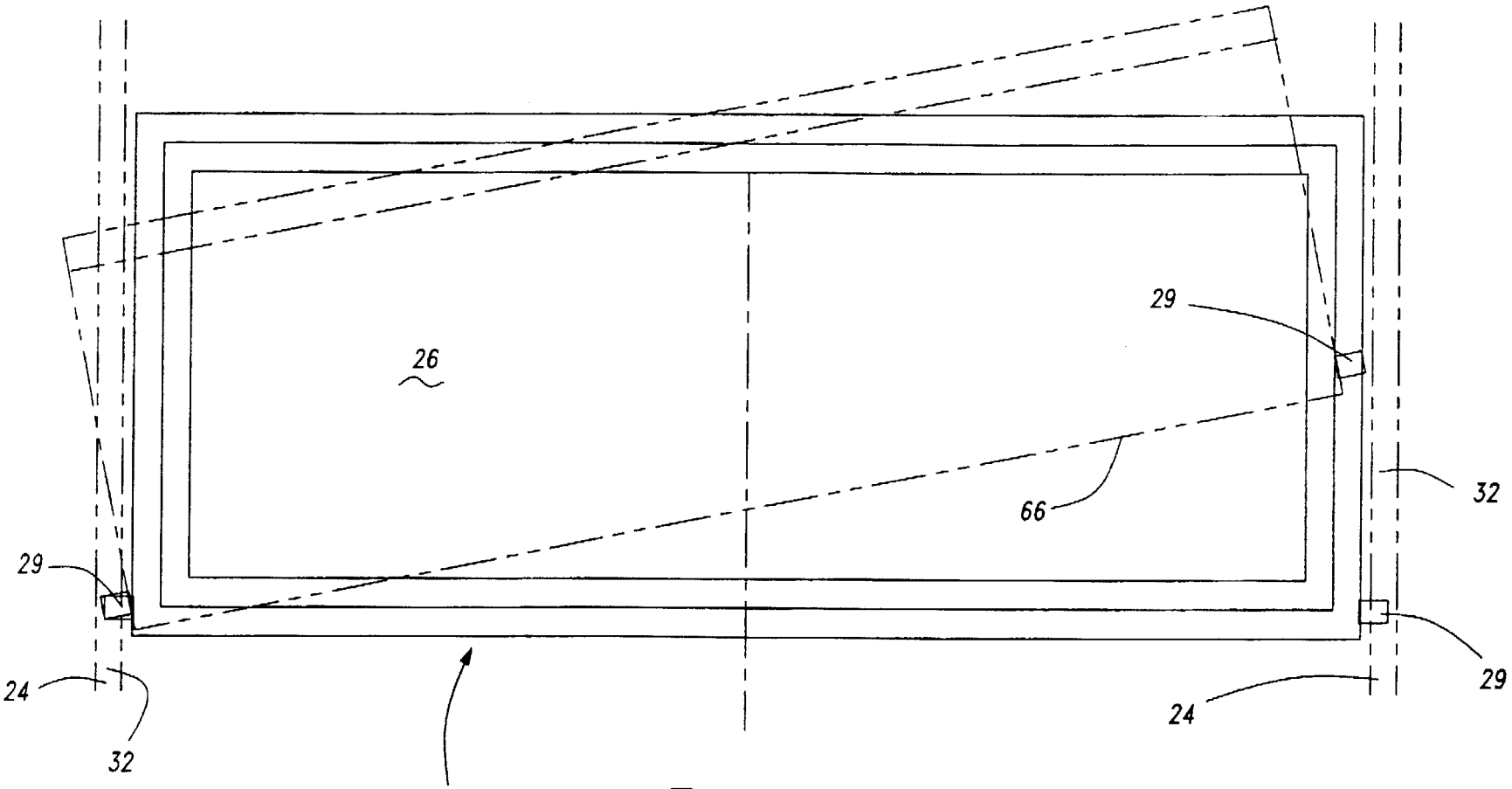
FIG. 8 schematically shows how the window sash may be removed or inserted into the window frame.

As shown in FIG. 8, the inventive window sash may be easily assembled into the window frame 24. As shown, one pivot pin 29 is initially inserted into its channel 32. This is shown as the leftmost pivot pin 29 in FIG. 8. In the position shown in FIG. 8, pivot pin 29 on the lefthand side is now received within the channel 32, while the remainder of sash 21 is pivoted forwardly of the window frame 24, and is also pivoted such that the bottom edge 66 is non-parallel to a horizontal plane. Because of these pivoting positions, the pivot pin 29 on the right side of the sash is laterally inward of its channel 32. Now, once the left pivot pin 29 is positioned in its channel, pivot pin 29 on the right side may be moved rearwardly such that it is laterally inward, but aligned with its channel 32. The sash 21 may then be lowered such that the pivot pin 29 moves into its channel 32.

The window sash is now at the position shown in solid line in FIG. 8 and is now assembled within the window frame 24. As can be appreciated, this is a very simple method of assembling the window sash to the window frame 24, and no hardware is necessary.

A preferred embodiment of this invention has been disclosed, however, a worker of ordinary skill in the art would recognize that certain modifications come within the scope of this invention. For that reason the following claims should be studied to determine the true scope and concept of this invention.

I claim:

1. A window assembly comprising:

a window frame to be received in a building, said window frame defining a generally rectangular shape, said generally rectangular shape having sides which are to extend vertically in an assembled position, said sides defining a channel along at least the majority of the length of said sides;

a window pane surrounded by a sash frame, said sash frame receiving pivot pins at each side, said pane and said sash frame defining a sash, said pivot pins defining a pivot axis for said sash frame in said window frame, and said pivot pins being sized to be received within said channels in said side window frame such that said pins may move within said channel along the majority of the length of said sides;

said window frame has a rear face extending along the portion of each said side of said window frame which defines said channel, and said window frame has a forward ledge defined along a bottom of said window frame extending generally horizontally in an assembled position, said window sash being pivotable within said window frame between opened and closed positions, and said window sash having structure abutting both said rear face and said forward ledge when in said open position to stop further pivoting movement of said window sash relative to said window frame:

said window sash contacts said rear face at a rear lower corner of said window sash, and said window sash being formed with a ledge extending forwardly of said sash frame, said ledge contacting said forward ledge of said window frame to provide said two stop locations; and said contact between said corner and said face is above a central axis of said pivot pins when said window sash is mounted in its intended orientation, and the contact between said ledge and said forward ledge is below the center axis of said pivot pin such that the combined stops provide a secure mount of said window sash.

2. A window as recited in claim 1, wherein a metal insert is received within said sash frame, said pivot pins being connected to said sash frame by a screw, and said screw extending into said metal insert.

3. A window as recited in claim 1, wherein said pivot pins are connected to said sash frame by screws, said screws extending through an enlarged boss in said sash frame.

4. A window as recited in claim 1, wherein said pivot pins are cylindrical.

5. A window assembly comprising:

a window frame to be received in a building, said window frame defining a generally rectangular shape, said generally rectangular shape having sides which are to extend vertically and parallel to each other in an assembled position, said sides defining a channel along at least the majority of the length of said sides, each of said sides having a rear face extending along the portion of said side which defines said channel, said window frame further having a forward ledge defined along a bottom of said window frame and extending generally horizontally when in an assembled position;

a window pane surrounded by a sash frame, said sash frame receiving cylindrical pivot pins at each side, said pane and said sash frame together defining a window sash, said pivot pins being fixed to sides of said sash frame, and defining a pivot axis for said window sash in said window frame, and said pivot pins being sized to be received within said channels in said side of said window frame such that said pins may move within said channel along the majority of the length of said sides, said sash frame having a rear lower corner which abuts said rear face of said window frame when said window sash is pivoted to an open position, said sash frame further being formed with a ledge extending forwardly of said sash frame, said ledge contacting said forward ledge of said window frame to provide a second stop, such that said window sash can pivot to an open position through a predetermined angle, but is then stopped against further outward pivoting movement.

* * * * *